US009175573B2

(12) United States Patent
Cairo et al.

(10) Patent No.: US 9,175,573 B2
(45) Date of Patent: Nov. 3, 2015

(54) DOVETAIL ATTACHMENT SEAL FOR A TURBOMACHINE

(71) Applicant: General Electric Company, Schenectady, NY (US)

(72) Inventors: Ronald Ralph Cairo, Greer, SC (US); Kevin Leon Bruce, Greer, SC (US)

(73) Assignee: General Electric Company, Schenectady, NY (US)

( * ) Notice: Subject to any disclaimer, the term of this patent is extended or adjusted under 35 U.S.C. 154(b) by 539 days.

(21) Appl. No.: 13/687,646

(22) Filed: Nov. 28, 2012

(65) Prior Publication Data

US 2014/0144157 A1 May 29, 2014

(51) Int. Cl.
*F01D 5/30* (2006.01)
*F01D 11/00* (2006.01)

(52) U.S. Cl.
CPC ..... *F01D 5/3092* (2013.01); *F01D 11/006* (2013.01); *F05D 2300/6033* (2013.01)

(58) Field of Classification Search
CPC ..... F01D 5/303; F01D 5/3092; F01D 11/006; F05D 2300/6033
See application file for complete search history.

(56) References Cited

U.S. PATENT DOCUMENTS

| | | | | |
|---|---|---|---|---|
| 4,500,098 | A * | 2/1985 | Wilcox et al. | 415/175 |
| 5,129,783 | A * | 7/1992 | Hayton | 415/209.3 |
| 5,257,909 | A | 11/1993 | Glynn et al. | |
| 5,630,700 | A * | 5/1997 | Olsen et al. | 415/134 |
| 6,296,172 | B1 | 10/2001 | Miller | |
| 6,575,430 | B1 | 6/2003 | Smith, III | |
| 6,655,913 | B2 * | 12/2003 | Vedantam et al. | 415/214.1 |
| 7,052,240 | B2 * | 5/2006 | Race et al. | 416/198 A |
| 8,016,565 | B2 * | 9/2011 | Berg et al. | 416/219 R |
| 8,038,405 | B2 * | 10/2011 | Ward et al. | 416/219 R |
| 8,827,642 | B2 * | 9/2014 | Walunj et al. | 416/1 |
| 8,985,960 | B2 * | 3/2015 | Connor et al. | 416/219 R |
| 2010/0008769 | A1 * | 1/2010 | Arness et al. | 415/174.2 |
| 2010/0008782 | A1 * | 1/2010 | Danescu et al. | 416/219 R |
| 2010/0068062 | A1 | 3/2010 | DiMascio et al. | |

* cited by examiner

*Primary Examiner* — Igor Kershteyn
(74) *Attorney, Agent, or Firm* — Ernest G. Cusick; Frank A. Landgraff

(57) ABSTRACT

A dovetail attachment seal for a turbomachine includes an outer seal member having a first end that extends to a second end through an intermediate portion, and at least one articulating element encapsulated, at least in part, by the outer seal member at one of the first and second ends. The at least one articulating element is slidingly disposed within the outer seal member.

20 Claims, 5 Drawing Sheets

DOVETAIL ATTACHMENT SEAL FOR A TURBOMACHINE

BACKGROUND OF THE INVENTION

The subject matter disclosed herein relates to the art of turbomachines and, more particularly to a dovetail seal for a turbomachine rotor blade.

Turbomachines typically include a compressor portion, a turbine portion, and a combustor assembly. Air passes through a number of compressor stages in the compressor portion and is compressed to form compressed air. A portion of the compressed air is passed to the combustor assembly, mixed with a combustible fluid, and combusted to form gases that are passed to the turbine portion. The gases expand through a number of turbine stages to create work. Each of the compressor stages and turbine stages include a rotor wheel to which is mounted a plurality of blades or buckets. The buckets react to the airflow or gases and impart a rotational force to the rotor wheel.

The buckets are typically mounted to the rotor wheel through a dovetail attachment. Generally, the blade will include a pin and the rotor wheel will include one or more slots that are sized to receive the pin. In some cases, pluralities of slots extend laterally across an outer diameter surface of the rotor wheel. In such cases, the rotor wheel will include a slot for each blade. In other cases, a single slot extends circumferentially about the outer diameter surface of the rotor wheel. In such cases, the slot is off-set from a centerline of the outer diameter surface and will include a loading portion. The loading portion is configured to receive each blade. Each blade is mounted to the rotor wheel and manipulated into place about the outer diameter surface. Once all blades are mounted, locking features are secured to the rotor wheel near the loading portion to prevent blade liberation. When using a plurality of slots, each pin will include a seal that is configured to engage with internal surfaces of the slot to reduce fluid leakage across the rotor wheel.

BRIEF DESCRIPTION OF THE INVENTION

According to one aspect of an exemplary embodiment, a dovetail attachment seal for a turbomachine includes an outer seal member having a first end that extends to a second end through an intermediate portion, and at least one articulating element encapsulated, at least in part, by the outer seal member at one of the first and second ends. The at least one articulating element is slidingly disposed within the outer seal member.

According to another aspect of the exemplary embodiment, a turbomachine includes a compressor portion, a combustor assembly including at least one combustor fluidically connected to the compressor portion, and a turbine portion mechanically linked with the compressor portion and fluidically connected to the compressor portion. The turbine portion includes at least one rotating member and a plurality of rotating elements mounted to the at least one rotating member through a dovetail attachment. Each dovetail attachment includes a dovetail attachment seal. The dovetail attachment seal includes an outer seal member having a first end that extends to a second end through an intermediate portion, and at least one articulating element encapsulated, at least in part, by the outer seal member at one of the first and second ends. The at least one articulating element is slidingly disposed within the outer seal member.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
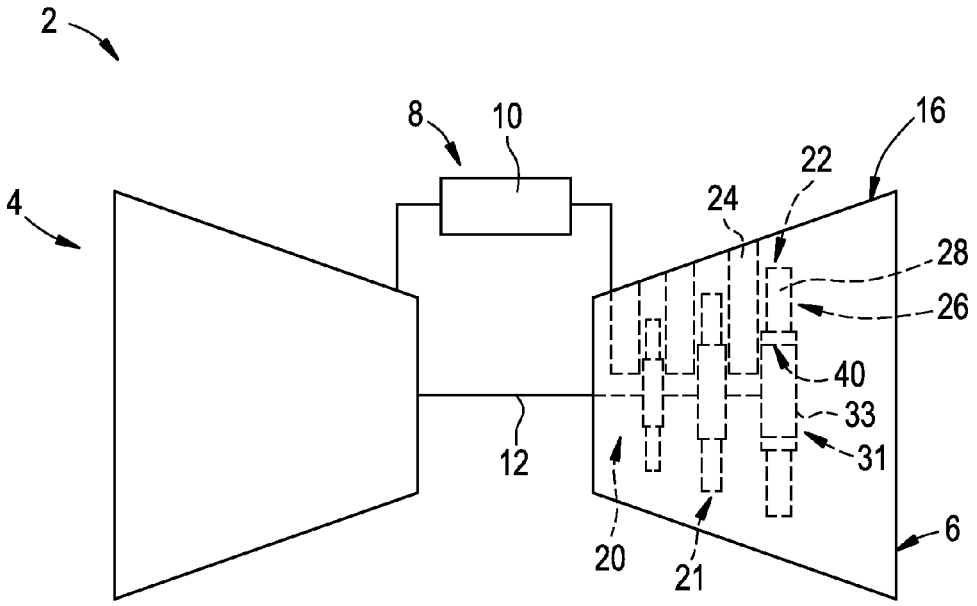
FIG. 1 is a schematic representation of a turbomachine including a dovetail attachment seal in accordance with an exemplary embodiment.

A turbomachine, in accordance with an exemplary embodiment, is illustrated generally at 2 in FIG. 1. Turbomachine 2 includes a compressor portion 4 fluidically linked to a turbine portion 6 through a combustor assembly 8. Combustor assembly 8 includes a plurality of combustors, one of which is indicated at 10, arranged in an annular array. Of course it should be understood that combustor assembly 8 can take on a variety of forms. Compressor portion 4 is also mechanically linked to turbine portion 6 through a common compressor/turbine shaft 12. Turbine portion 6 is shown to include a turbine housing 16 that encloses a number of turbine stages 20, 21 and 22. The number of turbine stages could vary. Each turbine stage 20-22 includes a corresponding plurality of stationary airfoil members or nozzles, such as indicated at 24, in connection with stage 22, arranged upstream from a plurality of rotating elements 26. Rotating elements 26 are shown in the form of airfoil members or blades, such as shown at 28. Airfoil members 28 are mounted to a rotating member 31 shown in the form of a rotor wheel 33 through a dovetail joint or attachment 40.

With this arrangement, air is drawn into compressor portion 4 through an intake (not shown). The air is compressed through a plurality of compressor stages (also not shown) to form a compressed airflow. A portion of the compressed airflow is passed to combustor assembly 8 and mixed with a combustible fluid in each combustor 10 to form a combustible mixture. The combustible mixture is combusted to form combustion gases that are directed to turbine portion 6. The combustion gases expand through stages 20-22 creating work that is used to power an external component such as a generator or pump. Of course, turbomachine 2 could also be used as a power source for a vehicle.

Figure 2:
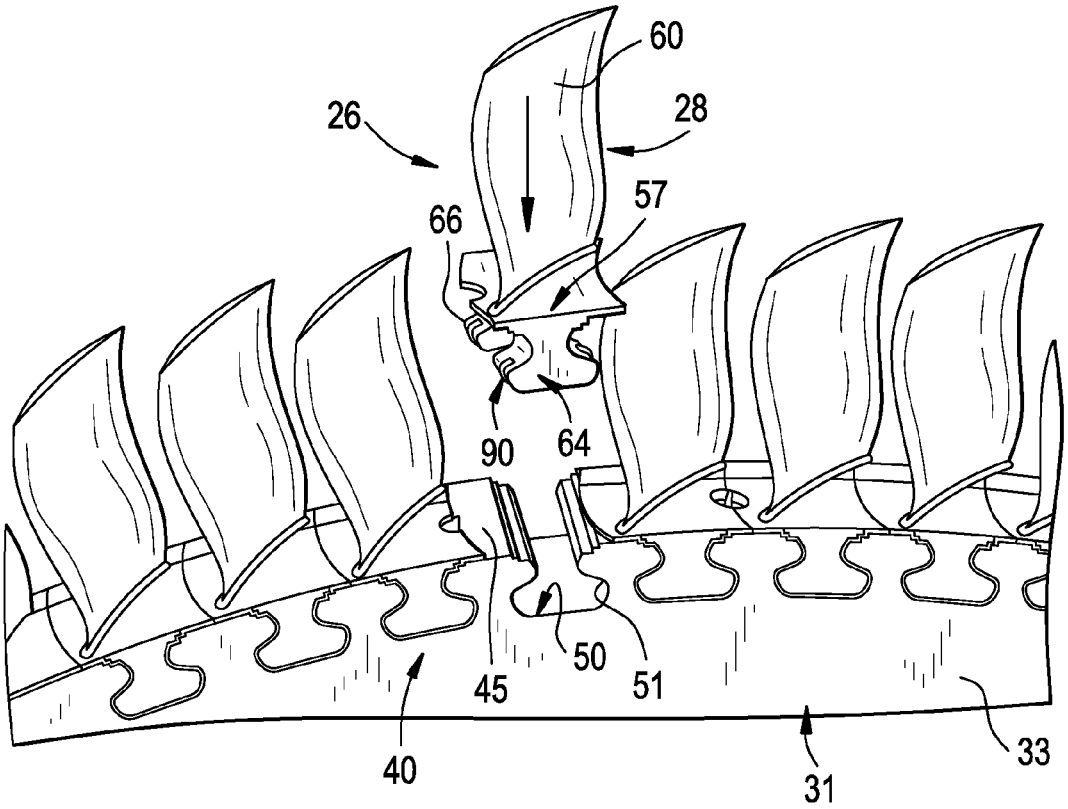
FIG. 2 is a partial perspective view illustrating a plurality of rotating elements mounted to a rotating member through a corresponding plurality of dovetail attachment joints.
Figure 3:
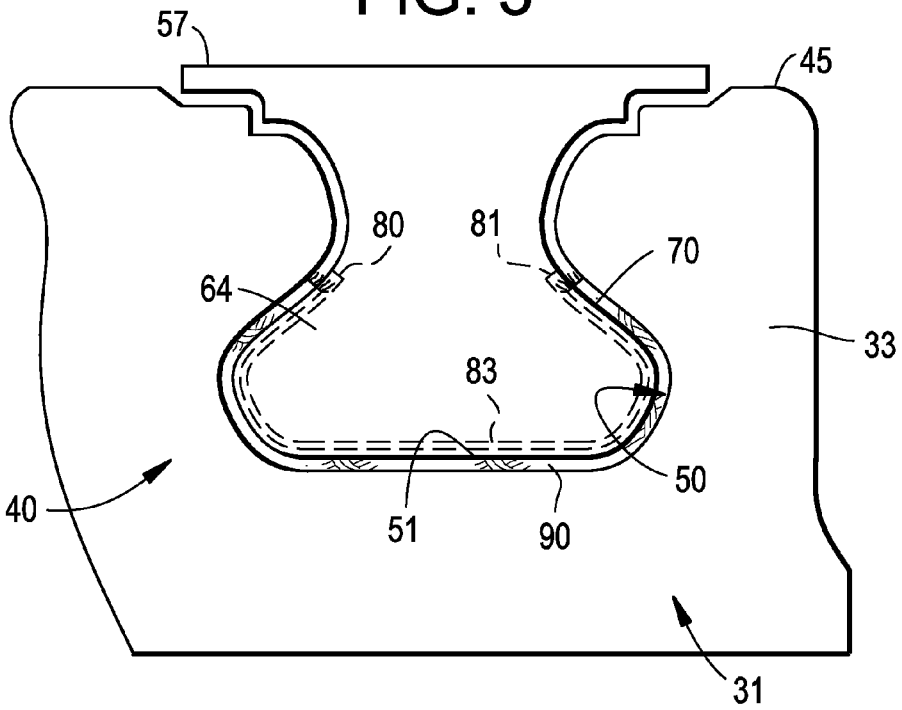
FIG. 3 is a plan view of a dovetail attachment joint having a dovetail attachment seal in accordance with an exemplary embodiment.
Figure 4:
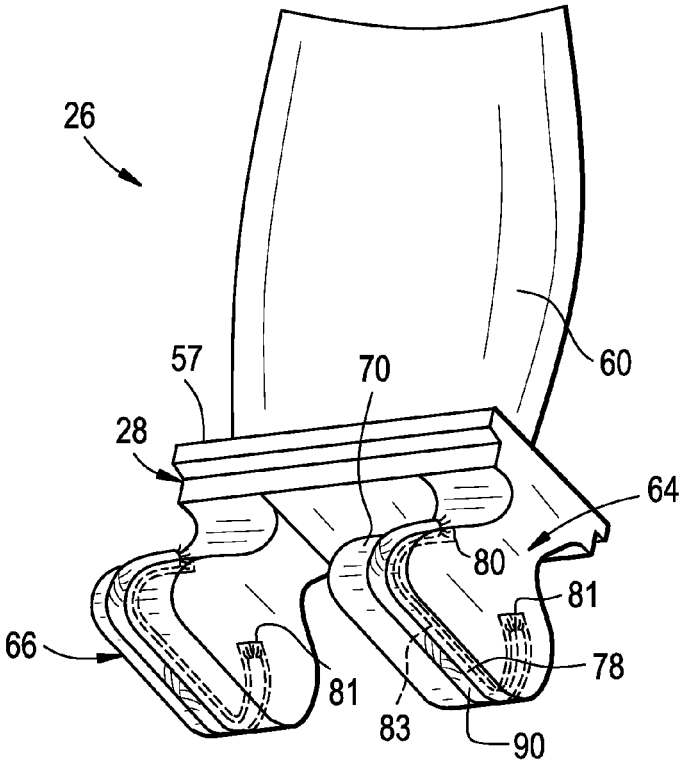
FIG. 4 is a partial perspective view of a dovetail member extending from one of the rotating elements having a dovetail attachment seal in accordance with an exemplary embodiment.

As shown in FIGS. 2-4, rotating member 31 includes an outer annular edge 45 including a plurality of axial slots 50. Each axial slot 50 includes an inner surface 51. As discussed above, axial slots 50 receive corresponding ones of rotating elements 26 through respective dovetail attachments 40. Thus, in the exemplary embodiment shown, each rotating element 26 includes a base portion 57 that supports an airfoil portion 60, a first dovetail or pin element 64 and a second dovetail or pin element 66. Airfoil portion 60 is exposed to hot gases flowing along a hot gas path (not separately labeled) of turbine portion 6. First and second pin elements 64 and 66 engage with axial slot 50 to establish dovetail attachment 40.

As each pin element 64 and 66 is similarly formed, a detailed description will follow with reference to pin element 64 with an understanding that pin element 66 includes similar structure. Pin element 64 includes a curvilinear edge 70 having a seal slot 78. Seal slot 78 includes a first end section 80 that extends to a second end section 81 through an intermediate section 83. A dovetail attachment seal 90 is arranged within seal slot 78. At this point it should be understood that rotating element 26 may include a slot insert (not shown) that supports dovetail attachment seal 90.

Figure 5:
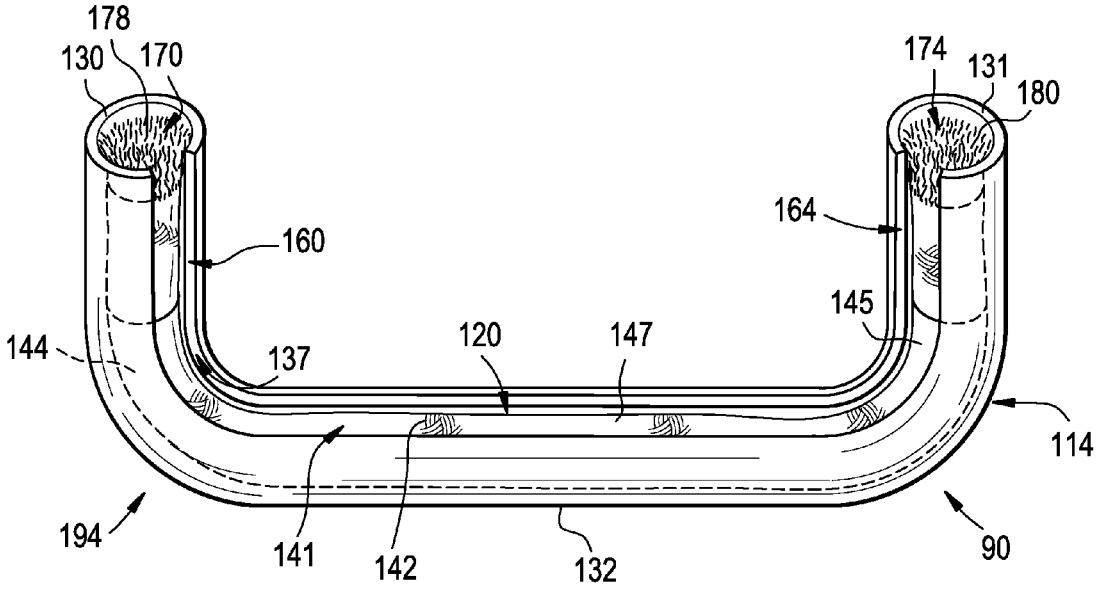
FIG. 5 is a plan view of a dovetail attachment seal including an outer seal member and an inner seal member in accordance with an exemplary embodiment.
Figure 6:
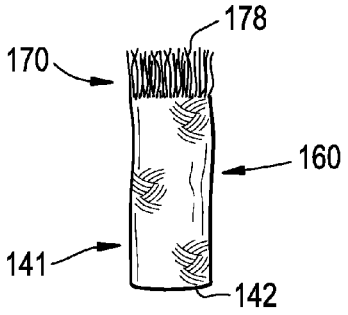
FIG. 6 is a partial plan view of the inner seal member of FIG. 5.

In accordance with the exemplary embodiment illustrated in FIGS. 5-6, dovetail attachment seal 90 includes an outer seal member 114 and an inner seal member 120. Outer seal member 114 includes a first end 130 that extends to a second end 131 through a curvilinear intermediate portion 132. Outer seal member 114 includes a channel 137 that extends from first end 130 to second end 131. Inner seal member 120 is encapsulated, at least in part, by outer seal member 114 and nests within channel 137. In accordance with an aspect of the exemplary embodiment, inner seal member 120 takes the form of a rope seal 141 formed from a plurality of fibers 142. Fibers 142 may be formed from a variety of materials. In accordance with an aspect of the exemplary embodiment, fibers 142 are formed from a ceramic matrix composite (CMC) material Inner seal member 120 includes a first end portion 144 that extends to a second end portion 145 through an intermediate section 147. A first articulating element 160 is provided at first end portion 144 and a second articulating element 164 is provided at second end portion 145. First and second articulating elements 160 and 164 are slidingly disposed or configured to articulate and/or shift within channel 137 at first and second ends 130 and 131 of outer seal member 114. Inner seal member 120 acts as a stop or a travel limiter for first and second articulating elements 160 and 164. In this manner, first and second articulating elements 160 and 164 may extend beyond respective ones of first and second ends 130 and 131 to engage with respective ones of first and second end sections 80 and 81 of seal slot 78 when subjected to a centrifugal force. First and second articulating elements 160 and 164 reduce leakage that may pass by dovetail attachment seal 90 at first and second ends 130 and 131 of outer seal member 114. In accordance with an aspect of the exemplary embodiment, first articulating element 160 includes a first compliant portion 170 and second articulating element 164 includes a second compliant portion 174. In accordance with an aspect of the exemplary embodiment, first and second articulating elements 160 and 164 may be formed from a rope with fibers from the rope defining first and second compliant portions 170 and 174. More specifically, fibers from the rope form bristles 178 and 180 on first and second articulating elements 160 and 164.

Figure 7:
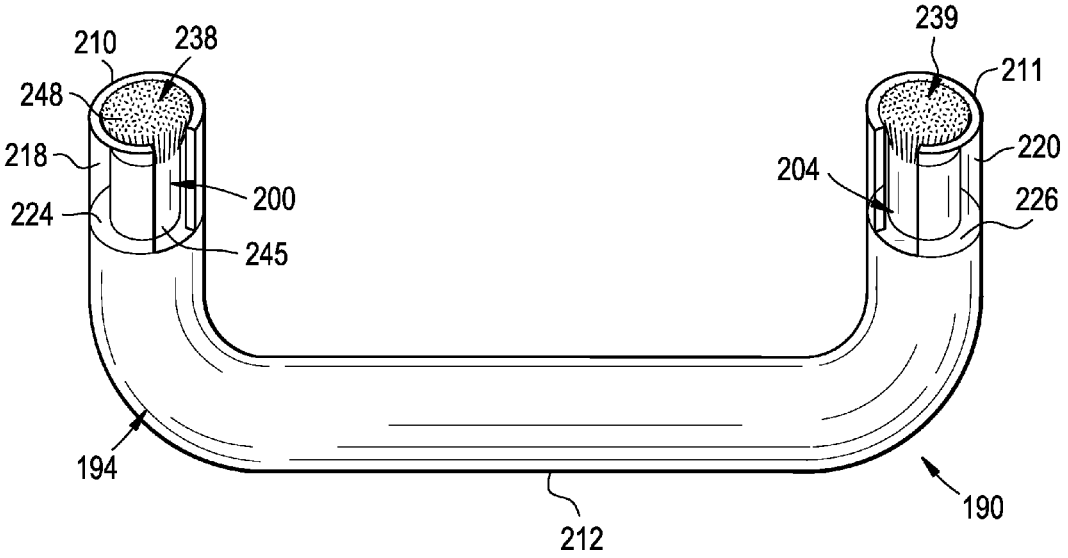
FIG. 7 is a plan view of a dovetail attachment seal including an outer seal member and first and second inner seal members in accordance with another aspect of an exemplary embodiment.
Figure 8:
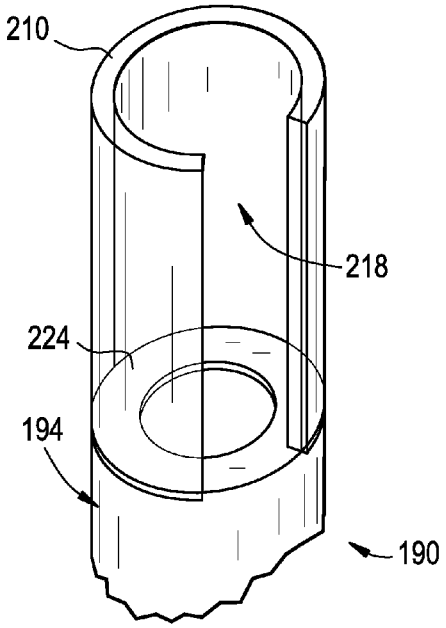
FIG. 8 is a partial perspective view of an end of the outer seal member of FIG. 7.

Reference will now be made to FIGS. 7 and 8 in describing a dovetail attachment seal 190 in accordance with another aspect of an exemplary embodiment. Dovetail attachment seal 190 includes an outer seal member 194, a first articulating element 200 and a second articulating element 204. Outer seal member 194 includes a first end 210 that extends to a second end 211 through an intermediate portion 212. First end 210 includes a first channel portion 218 and second end 211 includes a second channel portion 220. First channel portion 218 includes a first support surface 224. Second channel portion 220 includes a second support surface 226. First support surface 224 acts as a stop or travel limiter for first articulating element 200 and second support surface 226 acts as a stop or a travel limiter for second articulating element 204.

First articulating element 200 includes a first compliant portion 238 and second articulating element 204 includes a second compliant portion 239. In a manner similar to that described above, when subjected to a centrifugal force, first and second articulating elements 200 and 204 are slidingly configured within respective ones of first and second ends 210 and 211 of outer seal member 194 and abut first and second end sections 80 and 81 of seal slot 78.

Figure 9:
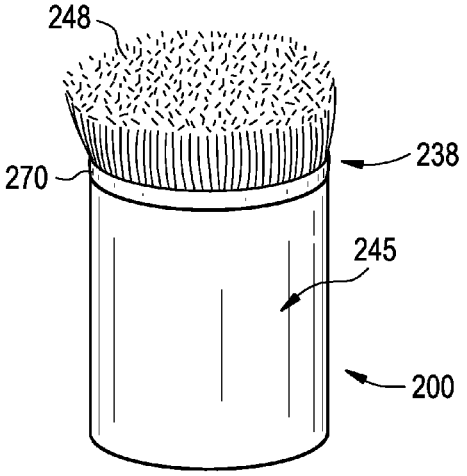
FIG. 9 is a perspective view of one of the first and second inner seal members of FIG. 7.

Reference will now be made to FIG. 9 in describing first articulating element 200 with an understanding that second articulating element 204 includes similar structure. First articulating element 200 includes a base portion 245 that supports first compliant portion 238. In the exemplary embodiment shown, first compliant portion 238 takes the form of a plurality of bristles 248 that extend from base portion 245. Bristles 248 are formed from wire and joined to base portion 245 by a metal band 270. In accordance with an aspect of the exemplary embodiment, plurality of bristles 248 are formed from a resilient, flexible metal wire that selectively abuts first end section 80 of seal slot 78 to limit fluid leakage through axial slot 50.

At this point it should be understood that the exemplary embodiments describe a dovetail attachment seal that includes an outer seal member and at least one articulating element. The articulating element shifts within the outer seal to engage with internal surface sections of a seal slot. The articulating elements may include a compliant portion that enhances engagement with rough surfaces in the seal slot. The articulating element shifts outward from the outer seal member when exposed to a centrifugal force to adjust for changes in clearances between end portions of the outer seal member and the internal surface sections of the seal slot resulting from thermal expansions and contractions at a dovetail attachment. While described as being bristles, it should be understood that the articulating compliant portion may take on other forms. Also, while described as being employed to seal a dovetail attachment that joins rotor blades to a turbine rotor, the dovetail attachment seal may be employed in a variety of locations and in a variety of environments and should not be considered as being limited to use in a turbomachine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A dovetail attachment seal for a turbomachine comprising:

an outer seal member including a first end that extends to a second end through an intermediate portion; and at least one articulating element encapsulated, at least in part, by the outer seal member at one of the first and second ends, the at least one articulating element is slidingly disposed within the outer seal member.

2. The dovetail attachment seal according to claim 1, wherein the outer seal member includes a channel extending from the first end to the second end, the dovetail attachment seal including an inner seal member arranged within the channel.

3. The dovetail attachment seal according to claim 2, wherein the at least one inner seal member includes a first end portion supporting a first articulating element and a second end portion supporting a second articulating element.

4. The dovetail attachment seal according to claim 1, wherein the at least one articulating element comprises a rope seal formed from a plurality of fibers.

5. The dovetail attachment seal according to claim 4, wherein the at least one articulating element comprises a compliant portion including a plurality of bristles comprising at least a portion of the plurality of fibers.

6. The dovetail attachment seal according to claim 1, wherein the at least one articulating element is formed from a ceramic matrix composite (CMC) material.

7. The dovetail attachment seal according to claim 1, wherein the at least one articulating element includes a base portion having a compliant portion.

8. The dovetail attachment seal according to claim 7, further comprising: a metal band joining the compliant portion to the base portion.

9. The dovetail attachment seal according to claim 7, wherein the compliant portion comprises bristles formed from wire.

10. The dovetail attachment seal according to claim 9, wherein the wire comprises a metal.

11. The dovetail attachment seal according to claim 1, wherein the outer seal member includes a first channel portion extending from the first end toward the intermediate portion and a second channel portion extending from the second end toward the intermediate portion.

12. The dovetail attachment seal according to claim 11, wherein the first channel portion includes a first support surface and the second channel portion includes a second support surface.

13. The dovetail attachment seal according to claim 12, wherein the at least one articulating element comprises a first articulating element arranged at the first support surface and a second articulating element arranged at the second support surface.

14. The dovetail attachment seal according to claim 1, wherein the intermediate portion is curvilinear.

15. A turbomachine comprising:

a compressor portion;

a combustor assembly including at least one combustor fluidically connected to the compressor portion;

a turbine portion mechanically linked with the compressor portion and fluidically connected to the compressor portion, the turbine portion including at least one rotating member and a plurality of rotating elements mounted to the at least one rotating member though a dovetail attachment, each dovetail attachment including a dovetail attachment seal comprising:

an outer seal member including a first end that extends to a second end through an intermediate portion; and at least one articulating element encapsulated, at least in part, by the outer seal member at one of the first and second ends, the at least one articulating element is slidingly disposed within the outer seal member.

16. The turbomachine according to claim 15, wherein the outer seal member includes a channel extending from the first end to the second end, the at least one articulating element including a first articulating element arranged at the first end and a second articulating element arranged at the second end, an inner seal member extending within the channel between the first and second articulating elements.

17. The turbomachine according to claim 15, wherein the at least one articulating element comprises a rope seal formed from a plurality of fibers, at least a portion of the plurality of fibers defining a compliant portion of the at least one articulating element.

18. The turbomachine according to claim 15, wherein the at least one articulating element includes a base portion and a compliant portion.

19. The turbomachine according to claim 18, wherein the compliant portion comprises a plurality of bristles formed from wire.

20. The turbomachine according to claim 15, wherein the outer seal member includes a first channel portion extending from the first end toward the intermediate portion and a second channel portion extending from the second end toward the intermediate portion, the first channel portion including a first support surface and a first articulating element and the second channel portion including a second support surface and a second articulating element.

* * * * *